United States Patent [19]

Schmidt et al.

[11] Patent Number: 4,843,978

[45] Date of Patent: Jul. 4, 1989

[54] TABLE WITH VERTICALLY ADJUSTABLE WORK SURFACE

[75] Inventors: Clayton C. Schmidt, Wilton, Iowa; Linn A. Steinbeck, New Boston, Ill.

[73] Assignee: HON Industries, Inc., Muscatine, Iowa

[21] Appl. No.: 77,737

[22] Filed: Jul. 27, 1987

[51] Int. Cl.[4] ..... A47B 57/00

[52] U.S. Cl. ..... 108/138; 312/27

[58] Field of Search ..... 108/7, 9, 10, 138, 80, 108/81; 297/374, 85, 68; 312/24, 27, 208, 225

[56] References Cited

U.S. PATENT DOCUMENTS

| | | | |
|---|---|---|---|
| D. 145,808 | 10/1946 | La Pidus . | |
| D. 270,787 | 10/1983 | Umanoff et al. . | |
| D. 270,788 | 10/1983 | Umanoff et al. . | |
| 719,625 | 2/1903 | Throm . | |
| 1,565,246 | 12/1925 | Axen | 312/27 |
| 2,516,281 | 7/1950 | Wilson . | |
| 2,541,075 | 2/1951 | Koch . | |
| 2,585,566 | 2/1952 | Lundstrom | 312/27 |
| 2,656,234 | 10/1953 | Koch . | |
| 2,744,805 | 5/1956 | McMahan | 312/27 |
| 2,976,094 | 3/1961 | Scherer . | |
| 3,140,559 | 7/1964 | Grow et al. | 108/10 X |
| 3,347,184 | 10/1967 | Kiraly . | |
| 3,433,444 | 3/1969 | Smith . | |
| 3,778,125 | 12/1973 | Gutmann, Jr. et al. . | |
| 3,814,366 | 6/1974 | Staifer . | |
| 3,938,766 | 2/1976 | Herbolsheimer et al. . | |
| 4,037,896 | 7/1977 | Kennedy, Jr. et al. . | |
| 4,077,333 | 3/1978 | Ballas . | |
| 4,316,082 | 2/1982 | Fritz . | |
| 4,345,803 | 8/1982 | Heck . | |
| 4,365,561 | 12/1982 | Tellier et al. . | |
| 4,379,429 | 4/1983 | Gubbe et al. . | |
| 4,496,200 | 1/1985 | Hagstrom et al. . | |
| 4,508,305 | 4/1985 | Johnson et al. | 108/9 |
| 4,625,657 | 12/1986 | Little et al. | 108/138 X |
| 4,644,875 | 2/1987 | Watt | 108/138 |

FOREIGN PATENT DOCUMENTS

| | | | |
|---|---|---|---|
| 3433137 | 3/1986 | Fed. Rep. of Germany | 108/138 |
| 925807 | 3/1947 | France | 312/27 |

*Primary Examiner*—Peter A. Aschenbrenner

*Attorney, Agent, or Firm*—Neuman, Williams, Anderson & Olson

[57] ABSTRACT

An adjustable table is provided which includes a table top disposed a predetermined distance above a supporting surface. This table top provides a work surface and support for office machinery such as a visual display terminal. The table also includes an adjustable platform which may support a detachable keyboard or similar devices. A unique linkage system supports this platform and allows the operator to adjust the platform to a desired elevation and to lock it in place using an actuating and brake assembly while maintaining maximum clear knee space beneath the platform.

19 Claims, 3 Drawing Sheets

FIG. 1A
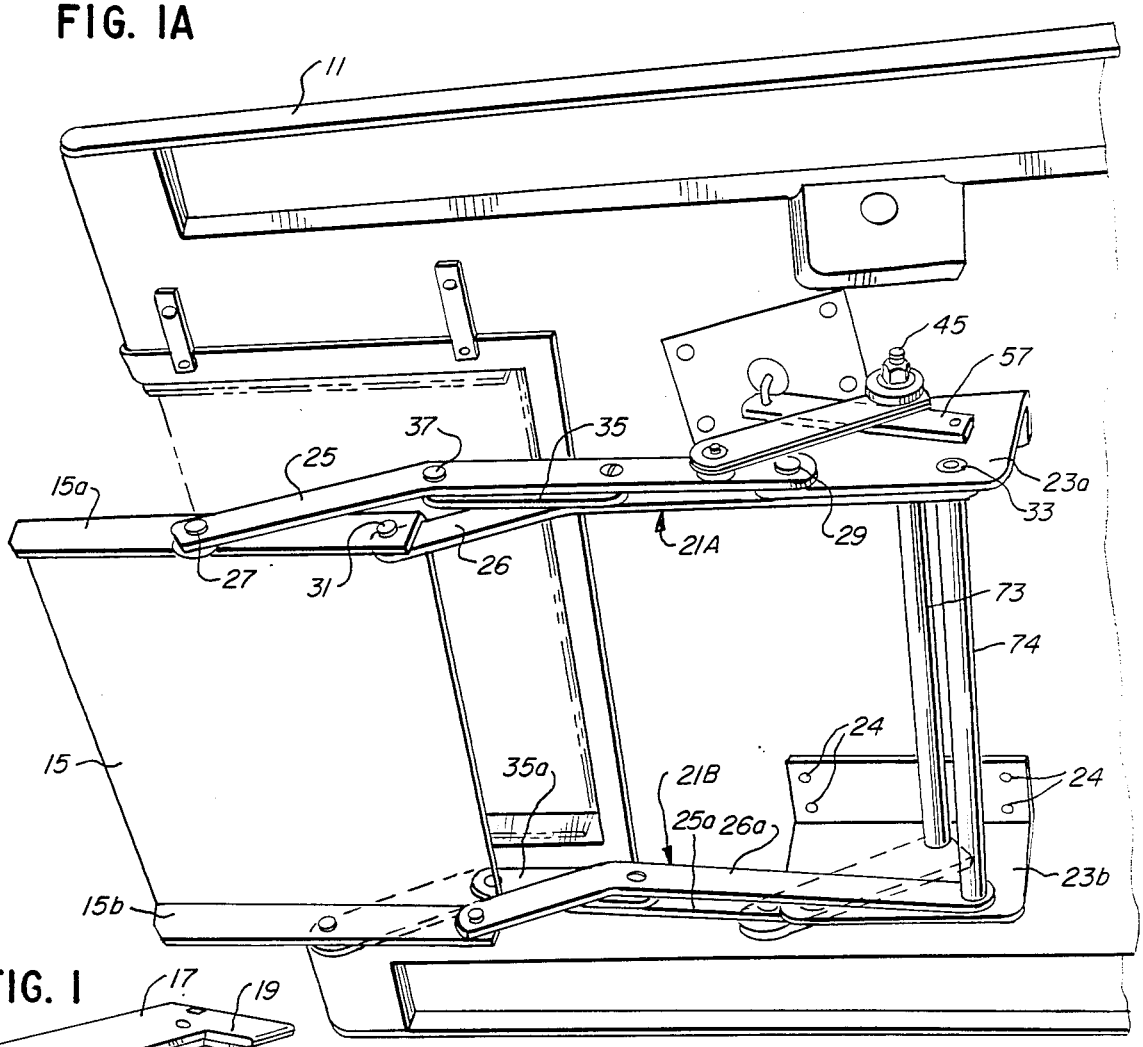
FIG. 1
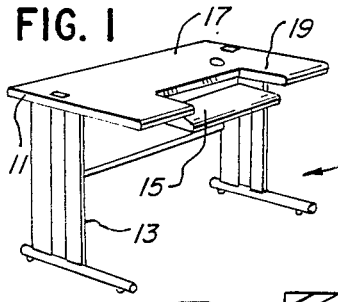
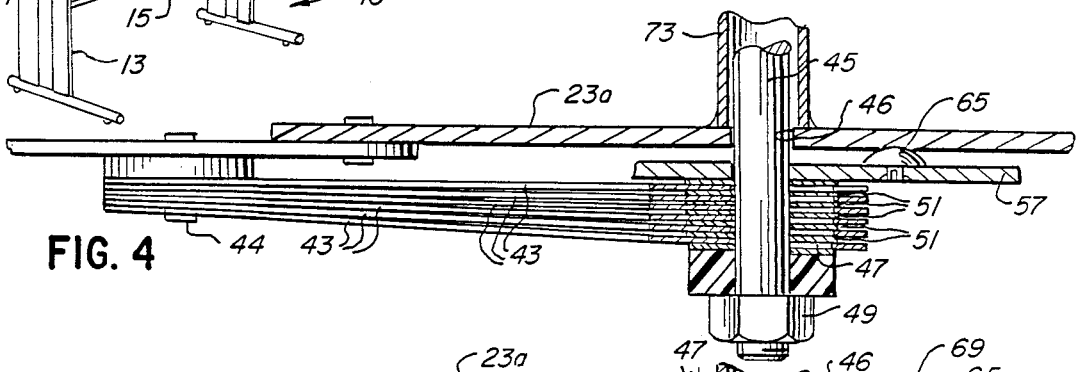
FIG. 4
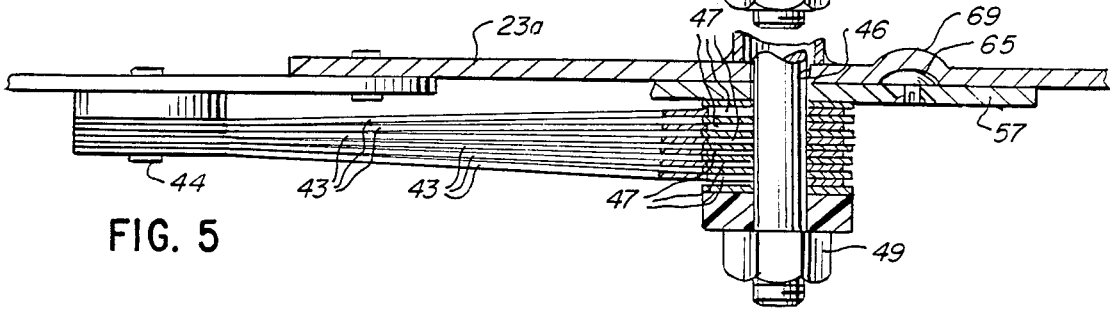
FIG. 5

R'
R''

TABLE WITH VERTICALLY ADJUSTABLE WORK SURFACE

BACKGROUND OF THE INVENTION

1. Field of the Invention

The present invention relates to a stand or table with a vertically adjustable work surface. More particularly, this invention relates to an improved table which provides a stationary work surface on which the user may place office machines such as a visual display terminal (VDT) and an adjustable work surface on which the user may place the keyboard of the visual display terminal.

2. Description of the Prior Art

Work stations for visual display terminals generally include a table which provides a work surface and support for the terminal. Many tables also include an adjustable platform for supporting detachable keyboards. Typically, an adjustable support connects the keyboard platform to the table and allows the operator to adjust the platform vertically to a desired height.

To assure comfort and safety for office machine operators, various organizations including the Human Factors Society, have instituted various standards for visual display terminal work station construction. These standards include loads which certain components of the station must support and leg space dimensions for a wide range of body sizes, from a very small woman (fifth percentile) to a very large man (ninety-fifth percentile). Thus, as an initial consideration, a work station table must have a table top which lies a substantial distance above the supporting floor surface to accommodate this wide range of body sizes. Consequently, the adjustable support for the platform must allow the user to place the platform in position along a substantial vertical range.

In addition to the minimum requirements provided by the industry standards, the work station table should include a platform support which maintains the platform in the desired horizontal position without any undesired deflections or movements. In addition, this support should allow the operator to quickly and easily adjust the platform to the desired elevation and should not expose the operator to injury from moving parts. Finally, the support should be of simple construction, durable and easy to maintain.

The adjustable table of the present invention provides a construction which maximizes unobstructed leg space and allows the operator to quickly and easily move the adjustable platform to any position over a vertical range. It provides a construction which minimizes the expense of manufacture and assembly and gives precise, uniform and reliable performance. It comprises a small number of components with sufficiently accurate and consistent tolerances to produce the required mechanical action and place the platform in proper position and alignment without exposing the operator to injury from moving parts.

OBJECT OF THE INVENTION

It is a general object of the present invention to provide an improved adjustable table which satisfies the requirements stated in the above text.

It is a more specific object of this invention to provide an adjustable table for visual display terminals or other such office machinery which includes a vertically adjustable platform and which meets the requirements for loads and leg space provided by the various industry standards.

It is another object of the present invention to provide a simple and reliable table with an adjustable platform and corresponding support which do not expose the operator to injury from moving parts.

It is yet another object of the this invention to provide an improved table, including a vertically adjustable platform, which has a simple construction and allows the operator or user to quickly and easily adjust the platform and the manufacturer to inexpensively manufacture it.

Other objects, advantages and features of the present invention will become apparent upon reading the following detailed description and appended claims and upon reference to the accompanying drawings.

SUMMARY OF THE INVENTION

In accordance with the preferred embodiment of the present invention, an improved, adjustable table is provided which achieves the foregoing objects. Generally, this table includes a horizontally disposed work furniture top member for providing a work surface and for supporting equipment, e.g. visual display terminals; means supportingly engaging the top to maintain it at a predetermined distance above a supporting floor surface; and an adjustable platform and corresponding support and locking mechanisms for providing a vertically adjustable work surface on which the user may place the keyboard of the visual display terminal or similar device.

The platform support maintains the platform in a horizontal orientation and pivots to allow vertical adjustment of the platform. The support has a shallow overall construction with the operating components also deeply recessed to maximize free knee space, permit easy coverage of the mechanism for a clean furniture appearance, and minimize the risk of injury to an operator. In the preferred embodiment, the platform support includes two identical linkages disposed beneath the table top, one linkage spaced horizontally from the other a predetermined distance along the width of the table top. Connecting brackets having the cross-sectional configuration of an inverted L pivotally mount the linkages to the bottom of the table top.

Each linkage includes two identical arms, spaced fore-and-aft of one another. Suitable hinge connections pivotally mount one end of each arm to the connecting bracket and the other end to the platform. On the bracket, the pivot points of the two arms lie on a generally horizontal first or bracket line, and are spaced apart a predetermined distance. Similarly, the pivot points of the two arms on the platform also lie on a generally horizontal line, i.e., parallel to the first line, and are spaced apart an equal distance. Therefore, the lines joining these four pivot points form a parallelogram. This arrangement allows the linkage to pivot while maintaining the platform in a generally horizontal position.

The linkage arms are elongate bars made of metal or any other suitably strong and rigid material. They form an elongate linkage which does not obstruct the space below the table. A bracing member having one of its ends pivotally connected to one arm and the opposite end pivotally connected to a corresponding point on the other arm adds rigidity to the linkage to prevent undesired deflections and movements.

To limit the linkages' pivoting motion and to lock the platform in the desired position, the adjustable table of the present invention includes at least one brake assembly. In the preferred embodiment, this brake assembly includes a plurality of elongate, plate-like members pivotally mounted at one end to one of the linkage arms and extending at an angle to those arms. The brake members are slidably mounted at the opposite end to the bracket which connects the linkage to the table top. At the ends connected to the bracket, the brake plates have elongate openings through which a mounting rod extends to support the plates on the bracket. The mounting rod lies offset from the bracket line so that the brake plate members extend at an angle to the linkage arms and have linear sliding movement at thier intersection with the mounting rod as the support linkage pivots. The ends of the elongate openings function as stops to limit the pivoting motion of the linkage; and each end represents one of the limits in the vertical motion.

The mounting rod extends between the two brackets and supports the brake plates between a bracket and a stop fixed at the end of the rod. It also supports a plurality of brake washers, each disposed between two consecutive brake plates and an actuating member. The actuating member drives the brake plates against the washers and the stop to prevent the plates from sliding and, accordingly to prevent the linkages from pivoting and the platform from moving.

The actuating member is a flat, elongate metal bar which is one component of an actuating assembly. This assembly also includes a spring loaded pushbutton disposed in an opening which extends through the table top. In addition, it includes a connecting arm disposed between the pushbutton and the actuating member for connecting these two components. This connecting arm transmits motion imparted to the pushbutton by the operator and the pushbutton spring to the actuating member. A suitable pivot connection mounts the actuating member at its middle section to the bracket which supports the linkage. One face of the actuating member engages and applies force to a brake plate and the opposite side includes at least one cam protuberance which engages the bracket.

When the user presses down on the pushbutton, the connecting arm transmits the motion to the actuating member which rotates to bring the protuberance into alignment with a detent formed in the bracket. The protuberance enters the detent and accordingly the actuating member moves away from the brake plates. Thus, the user disengages the brake and while maintaining pressure on the pushbutton may move the platform to a desired position. Upon release of the pushbutton, the spring forces the button upward; the connecting arm transmits the force of the spring to the actuating member; and the actuating member rotates in the opposite direction. As the protuberance moves out of the detent, the actuating member reengages the brake plate, forcing the plates into contact with the washers so that the plates cannot move.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIG. 1 is a prespective view of a table embodying the present invention.

FIG. 1A is a bottom perspective view of the table top, showing the adjustable platform and the linkage mechanism supporting the platform.

FIG. 4 is a sectional view taken along irregular line 4—4 in FIG. 2.

FIG. 5 is a sectional view taken along irregular line 5—5 in FIG. 3.

Figures 2, 3, 6, 7:
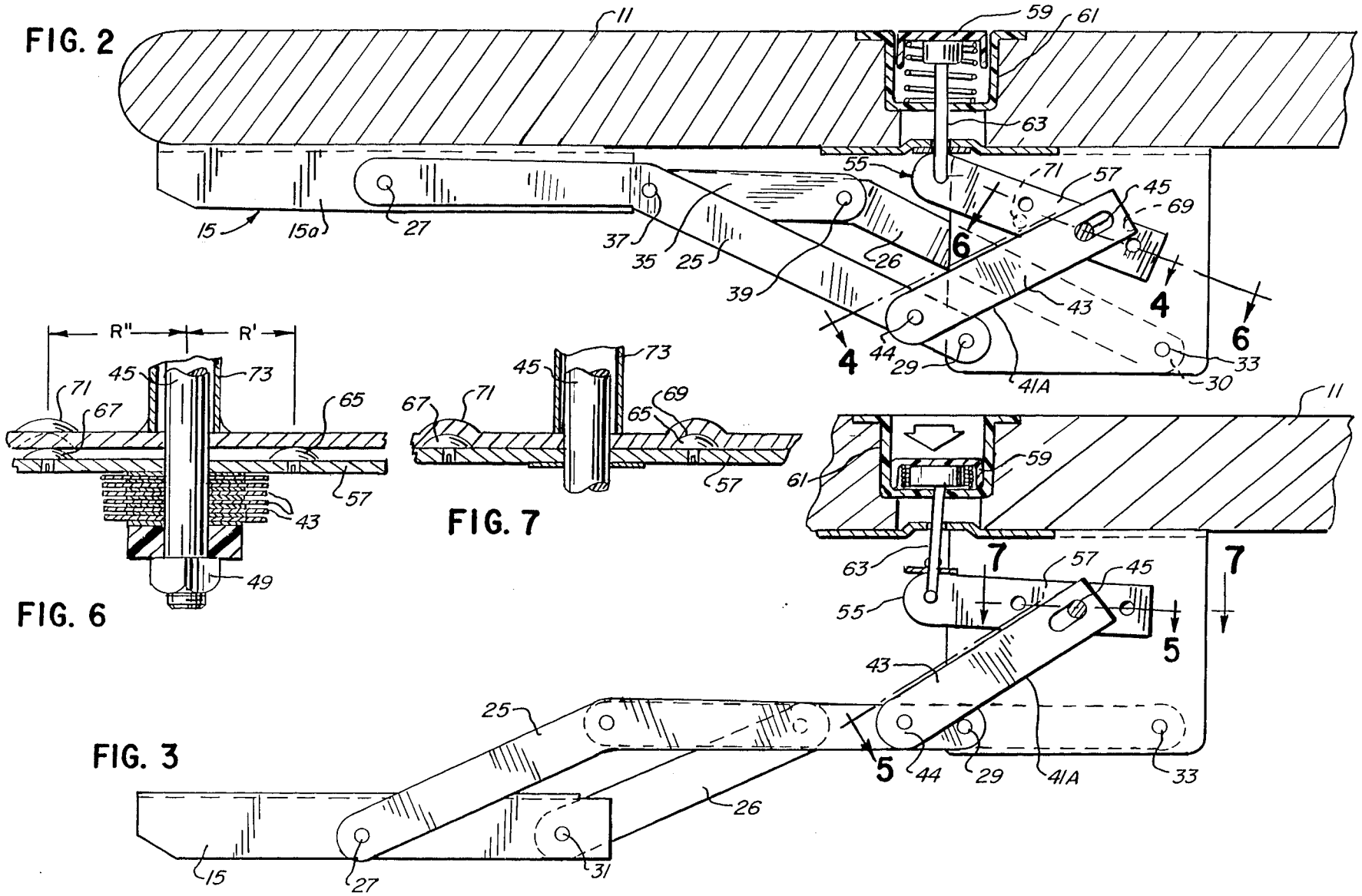
FIG. 2 is a sectional view, showing the adjustable platform and linkage support in side elevation with the platform at the upper limit of its motion.
FIG. 3 is a sectional view of the embodiment of FIG. 1, showing the keyboard platform at the lower limit of its motion.
FIG. 6 is a sectional view taken along line 6—6 in FIG. 2.
FIG. 7 is a sectional view taken along line 7—7 in FIG. 3.

While the following text describes the invention in connection with a preferred embodiment, one should understand that the invention is not limited to this embodiment. Furthermore, one should understand that the drawings are not necessarily to scale, and that they illustrate the preferred embodiment, in part, by graphic symbols, diagrammatic representations and fragmentary views. In certain instances, the drawings do not include details which are not necessary for an understanding of the present invention.

DETAILED DESCRIPTION OF THE DRAWINGS AND OF THE PREFERRED EMBODIMENT

Turning now to the drawings, FIG. 1 shows, at 10, an adjustable table of the present invention designed for use with a visual display terminal. The table generally includes a table top 11; a stationary support structure 13 disposed below the table top for supporting the table top and maintaining it at a predetermined distance above a supporting surface; and an adjustable platform 15.

The table top 11 includes a top surface 17 on which the user may place office machinery, e.g., a visual display terminal, or any other similar device. It also includes a cutaway portion 19. Disposed within or below this cutaway segment or portion 19 at the edge of the table top 11 lies the platform 15 which serves as a vertically adjustable work surface for the table. This platform typically supports a detachable keyboard for the visual display terminal or similar device which the table top 11 supports.

Although the preferred embodiment shows a rectangular table top 11 with a rectangular cutaway portion 19, the table top may have any one of a wide variety of configurations. With any one of these configurations, the vertically adjustable platform 15 lies along a side edge of the table top. In addition, in the preferred embodiment the platform 15 is a rectangular, metallic plate with downwardly projecting flanges **15*a* and 15*b*. But the platform 15** may also assume any other suitable configuration.

Referring now to FIG. 1A, parallelogram linkages 21A and 21B support the adjustable platform 15 and allow the user to adjust it vertically. These linkages lie beneath the table top, spaced apart across its width. Brackets **23*a* and 23*b* mount the linkages 21A and 21B, respectively, to the bottom of the table top 11. These brackets are preferably metal members having the cross-sectional shape of an inverted L. Suitable connecting devices, e.g., screws 24**, secure the brackets to the table top.

The linkage 21A has an inverted angle shape and includes two identical arms 25 and 26. These arms are elongate members made out of metal or any material having sufficient strength and rigidity. Each includes two segments whose longitudinal axes form an obtuse angle. These segments generally define an open and inverted V shape, i.e., an angle which lies open downward with an obtuse included angle. This configuration allows the arms to pivot through a predetermined range without obstructing the space beneath the table top. A suitable pivot connection mounts one end of the arm 25 to the flange 15*a*, as at 27, with the arm 25 disposed outside of flange 15*a*. A similar pivot connection mounts the other end of the arm 25 to the bracket 23*a*, as at 29, with the arm 25 disposed outward of the bracket 23*a*.

The arm 26 is identical to arm 25. Pivot connections mount one end of arm 26 to the flange 15*a*, as at 31, with the arm 26 disposed inward of the flange 15*a*, and the opposite end of arm 26 to the bracket 23*a*, as at 33, with the arm 26 disposed inward of the downwardly extending portion of the bracket. Since arms 25 and 26 are identical, the distance between pivot points 29 and 27 is equal to the distance between pivot points 31 and 33. Moreover, the lines which connect these four pivot points form a parallelogram, with the line between pivot points 29 and 33 and the line between pivot points 27 and 31 disposed horizontally and parallel to one another. This arrangement allows the linkage to maintain the platform 15 horizontally throughout the movement as described below and as shown in FIGS. 2 and 3. Pivot points 29 and 33 lie spaced below the table top, approximately midway between the upper and the lower limits of the platform 15's movement. This feature minimizes the horizontal inward and outward movement of the platform 15 as it moves with the linkage.

Also, the positioning of the support brackets and the inverted angle shape of the linkage maintains maximum clear knee space beneath the platform and the outer portion of the linkage. As seen in FIGS. 2 and 3, the outer portions of the linkage do not project beneath the platform 15 at any point but rather lie within or above its side flanges 15*a* and 15*b*. They lie generally parallel to and within the profile of the flanges 15*a*, 15*b* in the up position of FIG. 2 and above those flanges when in th various down positions, e.g., as in FIG. 3.

A bracing member 35 adds rigidity to the linkage structure and prevents undesired movement of the platform 15 and "chatter" of the linkage. Suitable pivot connections mount one end of the bracing member 35 to the arm 25 at point 37 and the other end to the arm 26 at point 39. The point 39 corresponds to the point 37, i.e., they represent the same location on the respective linkage arms. The member 35 stiffens the two arms and prevents them from displacing or bending inadvertently. Although the linkage 21A has only one bracing member, it may have more than one and the configuration of linkage components may vary.

The arms 25 and 26 and the bracing member 35 define a cantilever support, i.e., the linkage 21A, having an elongate configuration. This support extends between the bracket 23*a* and the platform 15 and does not obstruct the space beneath the platform at any point along the path of the platform. As stated in the text above, the angle shape of the arms 25 and 26 and their arrangement helps achieve this advantage.

The linkage 21B is identical to the linkage 21A and supports the platform end opposite the end which the linkage 21A supports. It includes an arm 25*a* which corresponds to the arm 25, an arm 26*a* which corresponds to the arm 26, and a cross-brace 35*a* which corresponds to the brace 35. Suitable pivot connections similarly mount these members to bracket 23*b* and flange 19*b* of the platform 15. As stated above, the members 25, 25*a*, 26 and 26*a* are elongate members, each including an end segment which lies at a slight angle to the other portion of the respective arm. This arm configuration allows the linkage to assume the configuration shown in FIGS. 2 and 3 and thus move in an area in which it does not obstruct the leg space underneath the platform 15 and the table top 11.

Figure 9:
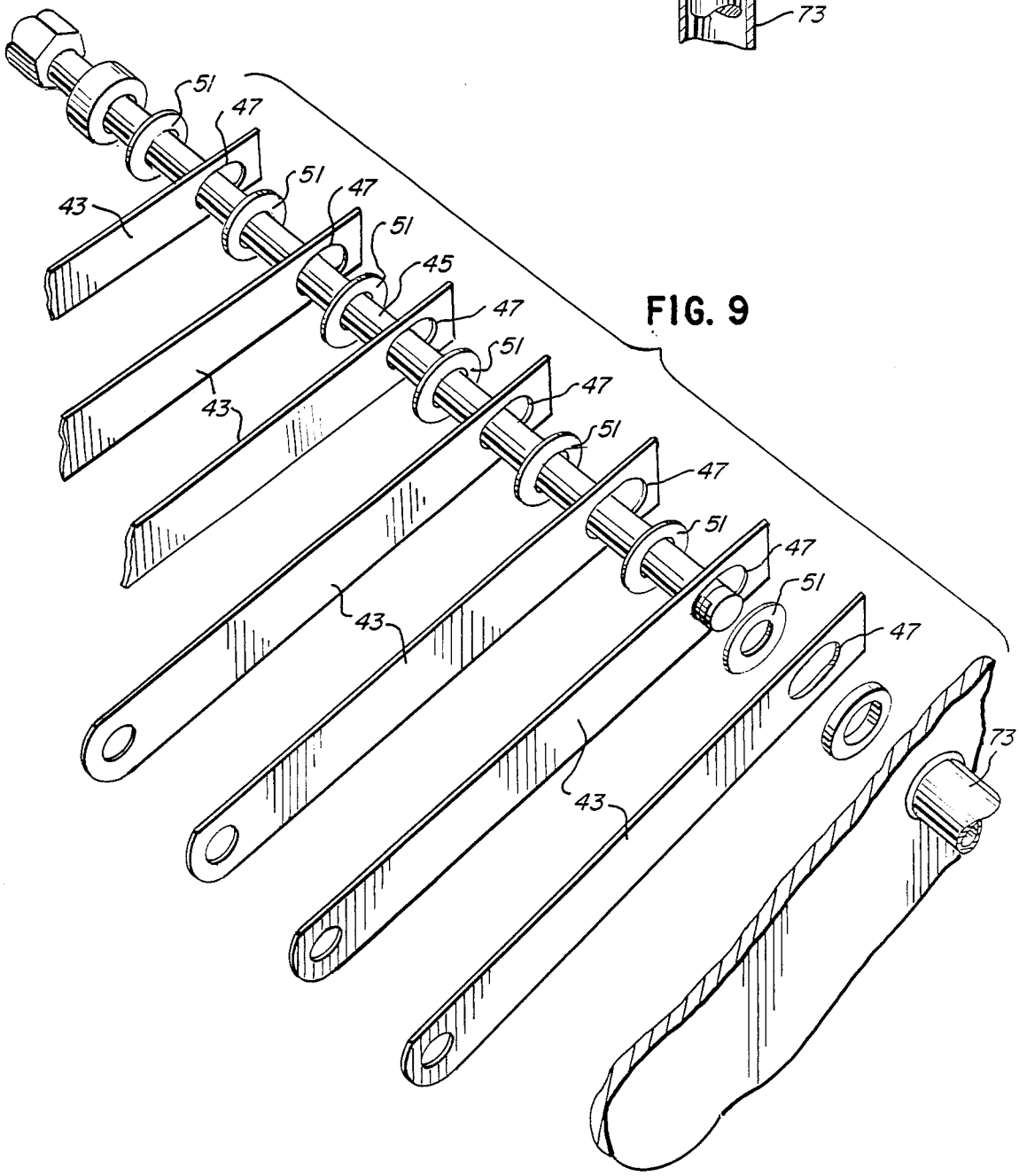
FIG. 9 is an exploded view of the brake assembly of the illustrated embodiment.

To control the movement of platform 15 between the two limits and to the range shown in FIGS. 2 and 3 and to lock the platform 15 in the desired position, the adjustable table includes a brake assembly 41A disposed on the bracket 23*a* and a brake assembly 41B disposed on the bracket 23*b*. The brake assembly 41A comprises a number of elongate brake plates 43 disposed in stacked, overlapping relation. (See FIGS. 4, 5 and 9.) A suitable pivot connection pivotally attaches one end of each member 43 to the linkage arm 25 at pin 44. An operating rod 45 (See FIGS. 4 and 5), which brackets 23*a* and 23*b* support, slidably mounts the opposite end of each brake plate 43 to the bracket 23*a*. Similarly, the rod 45 slidably mounts the brake plates of brake assembly 41B on the bracket 23*b*.

The rod 45 extends through openings 46 in the brackets 23*a* and 23*b* and through elongate openings 47 formed in the brake plates 43 for sliding movement through these openings. It lies generally perpendicularly to the brake plates and the downwardly extending plate segments of the brakets 23*a* and 23*b*. As stated above, it is also moveable in this direction. The openings 46 only allow the rod 45 to move in the direction of this longitudinal axis, but not in the transverse direction. Thus, it provides a laterally fixed mounting and braking reference.

A nut and pad assembly 49 secured to each end of the rod 45 facilitates the braking action described below. Brake pad washers 51 interspersed between the plates and between the plates and adjacent elements, and in a close fit around the rod 45, also facilitate the braking action by allowing the application of a braking force to each plate.

As the linkage 21A moves through its range of motion, i.e. between the positions of FIGS. 2 and 3, the outer ends of the plates 43 move along the arc of motion of pin 44 about pivot point 29. The elongated openings or slots 47 permit the corresponding longitudinal sliding movement of the plates relative to the fixed rod 45. The ends of the elongate openings 47 function as stops and, thus, define the limits of this pivoting motion of the linkage 21A and of the vertical movement of platform 15. When the user forces the platform 15 upward with corresponding pivoting of the linkages, the brake plates slide upward on the rod 45 until the rod 45 engages one end of the openings 47 as shown in FIG. 2. When the user forces the platform 15 downward, the brake plates 43 slide downward on rod 45 until the rod engages the opposite end of openings 47 as shown in FIG. 3.

To lock the linkage assembly in place between the limits described above, the table 10 includes an actuating assembly 55. This assembly 55 includes an actuating member 57 for moving the brake between a locked and unlocked mode. Preferably, the actuating member is a flat, elongate metal bar pivotally mounted at its midsection to the bracket 23*a* by pivoting on rod 45. The assembly 55 also includes a spring loaded pushbutton 59 disposed in an opening 61 which extends through the table top 11 and a connecting member 63 disposed between the member 57 and the pushbutton 59. The connecting member 63 transmits the force applied by the user on the pushbutton to the actuating member 57.

The actuating member 57 includes two protruding buttons, 65 and 67, which engage the bracket 23*a* and correspond to the detents 69 and 71 formed in the bracket 23*a* (See FIG. 6). The button 65 and the detent 69 are positioned the same radial distance from the pivot point of the actuating member 57. The button 67 and the detent 71 also are positioned the same radial distance from this pivot point, but this distance is different than the distance between the pivot point and the button 65 or the detent 69. This feature allows the user to force the buttons out of the detents easily, because, at different radii, the buttons move out of the detents at different rates as the actuating member 57 rotates about rod 45.

Although the preferred embodiment shows buttons 65 and 67 secured to the actuating member 57 and detents formed in the bracket 23*a*, the actuating member 57 may have the detents and the bracket 23*a* may include the buttons. In addition, the buttons may be an integral part of the actuating member 57 rather than separate parts secured to it.

In the free-standing position, the spring of the pushbutton 59 forces the actuating member 57 toward the position shown in FIG. 2, i.e., a position in which the buttons 65 and 67 cam outward on the sides of the detents or even may move entirely out of the respective detents. Thus, they do not lie in alignment with the detents 69 and 71 (See FIG. 6). Rather, in this brake engage mode, the buttons 65 and 67 engage the bracket 23*a* in pressure contact and force the actuating member 57 outward against the stack of brake plates 43 and brake pad washers 51. Thus, the actuating member applies a driving or clamping force on these plates 43 and washers 51 against the respective nut and pad assembly 49 to lock the brake plates 43 and prevent them from sliding. The user may adjust the pressure provided by the member by adjusting the nut and pad 49 at the end of rod 45.

Figure 8:
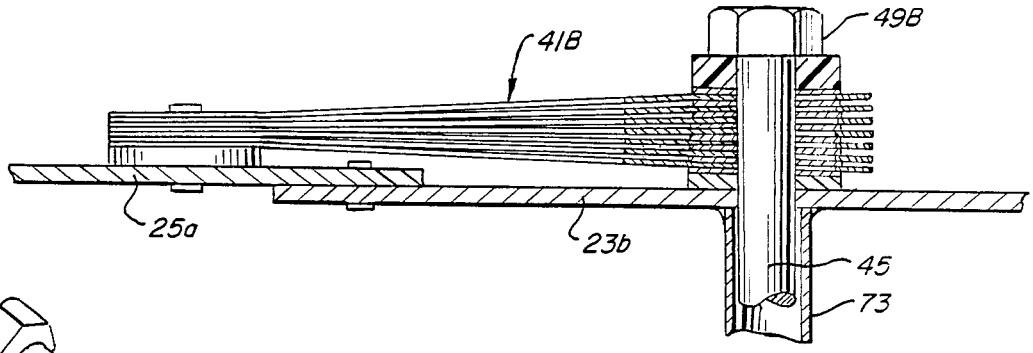
FIG. 8 is a sectional view of the brake assembly 41B.

The brake assembly 41B is similar to the assembly 41A. (See FIG. 8). However, the preferred embodiment does not include a second actuating assembly to engage and disengage the brake 41B. Rather, the rod 45 is free to slide axially in response to the force applied to assembly 49 by the actuating member 57, and thus to transmit this force to the brake 41B. In the brake engage mode, the rod 45 tends to move towards the bracket 23*a* (downward in FIGS. 3, 4 and 8) and also applies a driving or clamping force to the brake plates and the washers of the brake assembly 41B. In doing so, it forces the nut and pad assembly 49B inwardly and clamps the respective plates and washers of the brake 41B between the nut and pad assembly 49*b* and the bracket 23*b* to prevent the brake plates from sliding. In the brake release mode, the rod 45 slides in the opposite direction releasing all of the brake plates so that they may move.

Upon application of a downward force on the pushbutton 55 (see FIG. 3) of sufficient magnitude to overcome the pushbutton spring and move the actuating member 57, the actuating member pivots and rotates counterclockwise until buttons 65 and 67 register with and move into detents 69 and 71 (See FIG. 7). Here, the actuating member releases from its pressure contact with the brake plates 43, the washers 51 and the nut and pad assembly 49, thus releasing the plates of both brakes to allow them to slide back and forth and the linkages to pivot accordingly. In this brake release mode, the user may adjust the vertical position of the platform 15 by grasping the platform, moving it to the desired position, and then releasing the pushbutton.

Upon release of the pushbutton, the spring moves back to the free-standing position and forces the member 57 to rotate. Accordingly, the buttons slide out of the detends in a cam action and the actuating member moves to the locked or brake mode.

The adjustable table of the present invention includes two structural members 73 and 75 (see FIG. 1A) which provide lateral support and fixed spacing for the brackets 23*a* and 23*b*. These structural members are round metal tubes extending between the brackets 23*a* and 23*b*. The member 73 receives the rod 45 through its central opening and serves as the rods housing. Suitable connections, e.g., welds, secure one end of the member 73 to the bracket 23*a* around the openings 46 and the opposite end to the bracket 23*b*. Similar connections secure the member 75 to corresponding ends of the linkage arms 26 and 26*a*. In addition to these two members, the adjustable table of the present invention may include other such members secured to corresponding points on the linkage arms and the flanges 15*a* and 15*b* of the platform 15.

Thus, a table device has been provided which meets the aforestated objects. This table includes an adjustable platform which the user may move to any desired position along a predetermined vertical range. Linkages which support the platform allow the user to quickly and effectively move the platform to the desired position and lock it in place with a brake assembly without exposing the operator to injury from any moving parts. The linkages have a rigid construction which allows a manufacturer to use 1 inch flat wire to economically form most of the movable components of the adjustable table of the present invention, including the platform 15, the linkage arms and cross-bracing, the brake plates, and the actuating member. The adjustable table, therefore, has a simplified construction which minimizes the expense of manufacture and assembly and gives precise, uniform and reliable performance.

While the drawings and the text illustrate one embodiment of the present invention, one should understand, of course, that the invention is not limited to this embodiment. Those skilled in the art to which the invention pertains may make modifications and other embodiments employing the principles of this invention, particularly upon considering the foregoing teachings. For example, instead of having the brake assembly 41 disclosed above, the unique adjustable table support linkage may have a conventional ratchet assembly to adjust and secure the pivoting linkages and, accordingly, the platform 15 to the desired elevation. In addition, although the platform 15 is a one-piece unit it may include a two-piece arrangement with one piece adjustable horizontally. Finally, the linkage may include a counterbalance arrangement to further facilitate the positioning of the platform. The applicants, therefore by the appended claims intend to cover any such modifications and other embodiments and to incorporate those features which constitute the essential features of this invention.

What is claimed is:

1. A work station assembly comprising: a base having a top work surface and a side edge; an adjustable platform member disposed proximate said side edge of said base, said platform member having front and rear portions, a top work surface and a bottom surface; an adjustable linkage means pivotally mounted to said base and to said platform for supporting said platform and maintaining said platform horizontally as it is adjustably positioned along a predetermined vertical range of positions proximate and beneath said top work surface, said linkage means being a first elongate cantilever support disposed generally above and rearward of said bottom surface of said platform for pivotal movement above and rearward of said bottom surface of said platform wherein said linkage means includes a first arm and a second arm, each arm having a first elongate segment with a longitudinal axis and a second elongate segment with a longitudinal axis, said first and second arms each being pivotally mounted at one end to said base and at the opposite end to said platform, said pivot mounts of said arms defining a parallelogram with the pivot mounts of the respective corresponding ends of said first and second arms fixed in substantially horizontal alignment with one another and thereby defining two substantially horizontal sides of such parallelogram, and wherein said pivot mounts of said arms on said base define a horizontal plane and said vertical range of positions of the platform member are proximate to said horizontal plane; brake means connected to said linkage means and to said base for locking said linkage means at a desired position, said brake means being movable between a brake engage mode in which said brake means locks said linkage means at a selected position and a brake release mode in which said brake means releases said linkage means so that said linkage means may be adjusted; and actuating means disposed on said base for selectively placing said brake means in said engage and release modes.

2. The work station assembly of claim 1, wherein said longitudinal axis of said first segment and said longitudinal axis of said second segment defines an obtuse angle.

3. The work station assembly of claim 2, wherein said base pivot points of said first and second arms on said base lie substantially midway between the predetermined vertical range of movement of said platform.

4. The work station assembly of claim 1, wherein said brake means includes at least one brake plate pivotally mounted to said linkage means and slidably mounted to said base and a stop means secured to said base proximate said brake plate, said actuating means driving said brake plate into pressure contact with said stop means.

5. A work station assembly comprising: a base having a top work surface and a side edge; an adjustable platform member disposed proximate said side edge of said base, said platform member having front and rear portions, a top work surface and a bottom surface; an adjustable linkage means pivotally mounted to said base and to said platform for supporting said platform and maintaining said platform horizontally as it is adjustably positioned along a predetermined vertical range of positions, said linkage means being a first elongate cantilever support disposed generally above and rearward of said bottom surface of said platform for pivotal movement above and rearward of said bottom surface of said platform; connected to said linkage means and to said base for locking said linkage means at a desired position, said brake means being movable between a brake engage mode in which said brake means locks said linkage means at a selected position and a brake release mode in which said brake means releases said linkage means so that said linkage means may be adjusted; and actuating means disposed on said base for selectively placing said brake means in said engage and release modes, wherein said actuating means includes a spring loaded push button mounted on said base, an actuating member pivotally mounted to said base, an actuating member pivotally mounted to said base and a connecting member for transmitting motion from the push button to the actuating member to rotate the actuating member, said actuating member including cam means for camming action with said base whereby said actuating member drives said brake means.

6. The work station assembly of claim 1, wherein said platform is a flat, elongate, plate-like member.

7. The work station assembly of claim 1, wherein said base is a table top disposed a predetermined distance above a supporting surface and a supporting member subtending the table top and maintaining said table top at said predetermined distance above the supporting surface.

8. An improved work station assembly having a support member and an adjustable platform member, wherein the improvement comprises: a first support arm having first and second ends and disposed between said platform member and said support member; a second support arm having first and second ends and disposed between said platform member and said support member; said first end of said first support arm being pivotally mounted to said support member at a first pivot point, said first end of said second support arm being pivotally mounted to said support member at a second pivot point, said second end of said first support arm being pivotally mounted to said platform member at a third pivot point, and said second end of said second support arm being pivotally mounted to said platform member at a fourth pivot point, said first, second, third and fourth pivot points defining a parallelogram and said first and second support arms having a open V configuration, wherein said third and fourth pivot point are in substantially fixed horizontal alignment and said first and second pivot points are fixed in substantial horizontal alignment and define a horizontal plane, and wherein the platform member has a vertical range of positions which are substantially proximate to said horizontal plane to preclude substantial horizontal movement of said platform member.

9. The improvement of claim 8, wherein said first and second support arms are flat, elongate, metallic members.

10. An improved work station assembly having a base, a moveable platform, and a support disposed between said base and said platform and pivotally mounted to said base and said platform for supporting said platform from said base, wherein the improvement comprises: at least one brake plate pivotally mounted to said support and slidably mounted to said base; a stop means secured to said base proximate said brake plate; and an actuating member disposed on said base, said actuating member being moveable between a first and second position, in said first position said actuator member providing force to place said brake plate in pressure contact with said stop means and to prevent said brake plate from moving, in said second position said actuating member allowing said brake plate to move.

11. The improvement of claim 10, wherein said brake plates are flat, elongate, and metallic.

12. A work station assembly comprising a top member defining an upper work surface and having an underside, a vertically adjustable platform disposed proximate one edge of said top member, and a support linkage mounted on said underside and attached to said platform for supporting said platform in horizontal orientation while permitting vertical adjustment thereof, said linkage including a bracket attached to said underside inward of said platform relative to said edge and projecting downward from said underside and support links joined to said bracket at pivot mounts horizontally spaced beneath said underside and to said platform at pivot mounts horizontally spaced on said platform, said pivot mounts thereby defining a parallelogram support for said platform, said parallelogram having two substantially horizontal sides, and each of said links being of an obtuse angular configuration with the included angle open downward whereby said links do not obstruct the knee space below said platform.

13. A work station assembly comprising a top member defining an upper work surface and having an underside, a vertically adjustable platform disposed proximate one edge of said top member, and a support linkage mounted on said underside and attached to said platform for supporting said platform in horizontal orientation while permitting vertical adjustment thereof, said linkage including a bracket attached to said underside inward of said platform relative to said edge and projecting downward from said underside and support links joined to said bracket at pivot mounts horizontally spaced beneath said underside and to said platform at pivot mounts horizontally spaced on said platform, said pivot mounts thereby defining a parallelogram support for said platform, wherein said bracket pivot points lie substantially midway in a predetermined vertical range of positions of said platform and wherein each of said links is of an angular configuration with the portion attached to the platform disposed generally horizontally and adjacent to said platform and the included angle open downward whereby said links do not obstruct the knee space below said platform.

14. The work station assembly of claim 13, wherein one leg of each link extends upward in the upper limit of said platform and the other leg of each link extends substantially horizontally along an edge of said platform.

15. The work station assembly of claim 14, wherein said links operate above the lower surface of said platform to maintain free space beneath said platform.

16. The work station assembly of claim 12, wherein said linkage has a shallow overall shape.

17. The work station assembly of claim 2, wherein said linkage means includes a second elongate cantilever support and said linkage means further includes rotatable means interconnecting said first elongate cantilever support and second elongate cantilever support.

18. The workstation assembly of claim 17, wherein said second elongate cantilever support includes third arm and a fourth arm, said third and fourth arms being pivotally mounted at one end to said base and at the opposite end to said platform and wherein said rotatable interconnecting means is fixedly connected to both said first arm and said third arm, whereby said first arm and said third arm move in synchronization.

19. The improvement of claim 10, wherein said base includes a first detent and a second detent and said actuating member is pivotally mounted to said base at an actuator pivot point, said actuating member including a first opposing detent corresponding to said first detent and a second opposing detent corresponding to said second detent, and wherein said first detent and first opposing detent are positioned the same first radial distance from said actuator pivot point and said second detent and second opposing detent are positioned the same second radial distance from the actuator pivot point, and said second radial distance differs from said first radial distance.

* * * * *